United States Patent [19]

Vail, Jr.

[11] Patent Number: 4,706,593

[45] Date of Patent: Nov. 17, 1987

[54] SWIVELING WIND SCOOP

[76] Inventor: Philip G. Vail, Jr., 806 Monticello Ct., Cape Coral, Fla. 33904

[21] Appl. No.: 717,100

[22] Filed: Mar. 28, 1985

[51] Int. Cl.[4] ..... B63B 19/06

[52] U.S. Cl. ..... 114/211; 98/37; 98/65

[58] Field of Search ..... 114/211; 52/199, 219, 52/198; 98/37, 64, 65

[56] References Cited

U.S. PATENT DOCUMENTS

| | | | |
|---|---|---|---|
| 128,929 | 7/1872 | Tucker | 98/37 |
| 254,360 | 2/1882 | Moore | 98/37 |
| 1,115,315 | 10/1914 | Hunt | 98/37 |
| 2,130,603 | 9/1938 | Spelman | 114/211 |
| 4,111,106 | 9/1978 | Burns | 98/37 |
| 4,434,740 | 3/1984 | Childs | 114/211 |

FOREIGN PATENT DOCUMENTS

| | | | |
|---|---|---|---|
| 676383 | 6/1929 | France | 98/65 |
| 1087112 | 2/1955 | France | 114/211 |
| 82217 | 10/1956 | Norway | 114/211 |
| 12714 | 10/1900 | United Kingdom | 98/65 |

OTHER PUBLICATIONS

E&B Marine Catalog, p. 131, "Windscoop".

*Primary Examiner*—Joseph F. Peters, Jr.
*Assistant Examiner*—Edwin L. Swinehart
*Attorney, Agent, or Firm*—Armstrong, Nikaido, Marmelstein & Kubovcik

[57] ABSTRACT

A wind scoop for ventilating the enclosed interior area of a boat through a hatch opening thereof is disclosed. The wind scoop comprises a flexible sail for continuously directing an air flow into the hatch opening independent of the direction of the boat with respect to the wind, a mast for rotatably supporting the sail above the hatch opening, and fasteners for holding the mast to the boat above the hatch opening. A wing mechanism responsive to changes in the direction of the wind for changing the orientation of the sail and a swivel mechanism for rotating the sail on the mast are also disclosed. An auxiliary scoop for mounting within the boat to further direct air flow within the boat, and a rain cover for mounting above the wind scoop may be provided.

10 Claims, 3 Drawing Figures

SWIVELING WIND SCOOP

FIELD OF THE INVENTION

This invention relates to ventilation devices for directing a flow of air to the interior space of a boat, and more particularly to a wind scoop for ventilating the living space below the deck of a boat with fresh air.

BACKGROUND OF THE INVENTION

One of the persistent problems encountered by boaters is the excessive heat and humidity which collects in the interior enclosed spaces of a boat such as a power boat or sail boat. Since these boats are exposed to direct sunlight for extended periods, the interior living space of the boat often becomes overheated.

Numerous attempts have been made in the prior art to solve this problem by ventilating the enclosed area of boats. For example, U.S. Pat. No. 59,264 to Raymond describes a wind sail which includes four wings for catching the wind from different directions to direct fresh air down into the vessel. U.S. Pat. No. 1,533,344 to Singleton discloses a ship ventilator cowl which includes a windmill mounted in the cowl for automatically turning the cowl into the wind.

U.S. Pat. No. 3,757,664 to Jalbert describes a cloth ventilator which is fixed in a hatchway of a vessel so that the wind can blow into the ventilator in any direction and be directed downwardly into the bottom portion of the vessel.

Other ventilation devices for ships are described in U.S. Pat. No. 1,076,609 to Searcy, U.S. Pat. No. 665,507 to Carrico, and U.S. Pat. No. 1,330,569 to Ahern.

The prior art ventilating structures are generally cumbersome, expensive to build, and are impractical for use with small boats such as pleasure craft owned and used by individuals. The most commonly used ventilator at the present time is a fixed sail-like device which must be attached to the hatch and mast of a boat and must be repositioned manually whenever the boat changes direction with respect to the wind. Thus, these devices are not readily adaptable to use on power boats having no mast.

At the present time, there is no practical way to maintain a flow of ventilating air into the interior enclosed space of a boat regardless of the direction of the boat with respect to the wind. Accordingly, it is a primary object of this invention to automatically and continuously direct an air flow into the hatch opening of a boat regardless of the direction of the boat with respect to the wind.

It is a further object of this invention to automatically swivel a wind scoop in response to the changes in the direction of the wind.

Another object of the invention is to further direct the flow of ventilating air within a boat through the use of an auxiliary scoop.

A further object of the invention is to economically and efficiently ventilates the interior of both sail boats and power boats.

Additional objects and advantages of the invention will be set forth in part in the description that follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purpose of the invention, as embodied and broadly described herein, the wind scoop of the present invention is for ventilating the enclosed interior area of a boat through a hatch opening thereof. The wind scoop comprises flexible sail means for continuously directing an air flow into the hatch opening regardless of the direction of the boat with respect to the wind; mast means for rotatably supporting the sail means above the hatch opening; and means for fastening the mast means to the boat above the hatch opening.

Preferably, the wind scoop also includes wing means responsive to changes in the direction of the wind for changing the orientation of the sail means; and swivel means for rotating the sail means on the mast means. It is also preferred that the sail means include a sail having a scoop-like shape, and that the swivel means include a hollow vertically oriented rod for supporting the sail. The hollow rod preferably has upper and lower portions and the swivel means preferably includes a horizontally oriented member attached to the lower end for further supporting the sail.

It is also preferred that the mast means include a frame for attachment to the boat and a mast extending vertically from the frame. The hollow rod is typically sized for receiving the mast into the hollow portion thereof for rotating the hollow rod on the mast.

Preferably, an auxiliary scoop is mounted within the boat below the hatch for further directing the air flow within the boat. The auxiliary scoop includes means for attaching the scoop to the boat, such as velcro fasteners or snaps. A rain cover may also be provided for mounting above the wind scoop.

BRIEF DESCRIPTION OF THE DRAWINGS

The accompanying drawings which are incorporated in and constitute a part of this specification, illustrate one embodiment of the invention, and, together with a description, serve to explain the principles of the invention.

Of the drawings.

DESCRIPTION OF THE PREFERRED EMBODIMENT

Reference will now be made in detail to the present preferred embodiment of the invention, an example of which is illustrated in the accompanying drawings.

Figure 1:
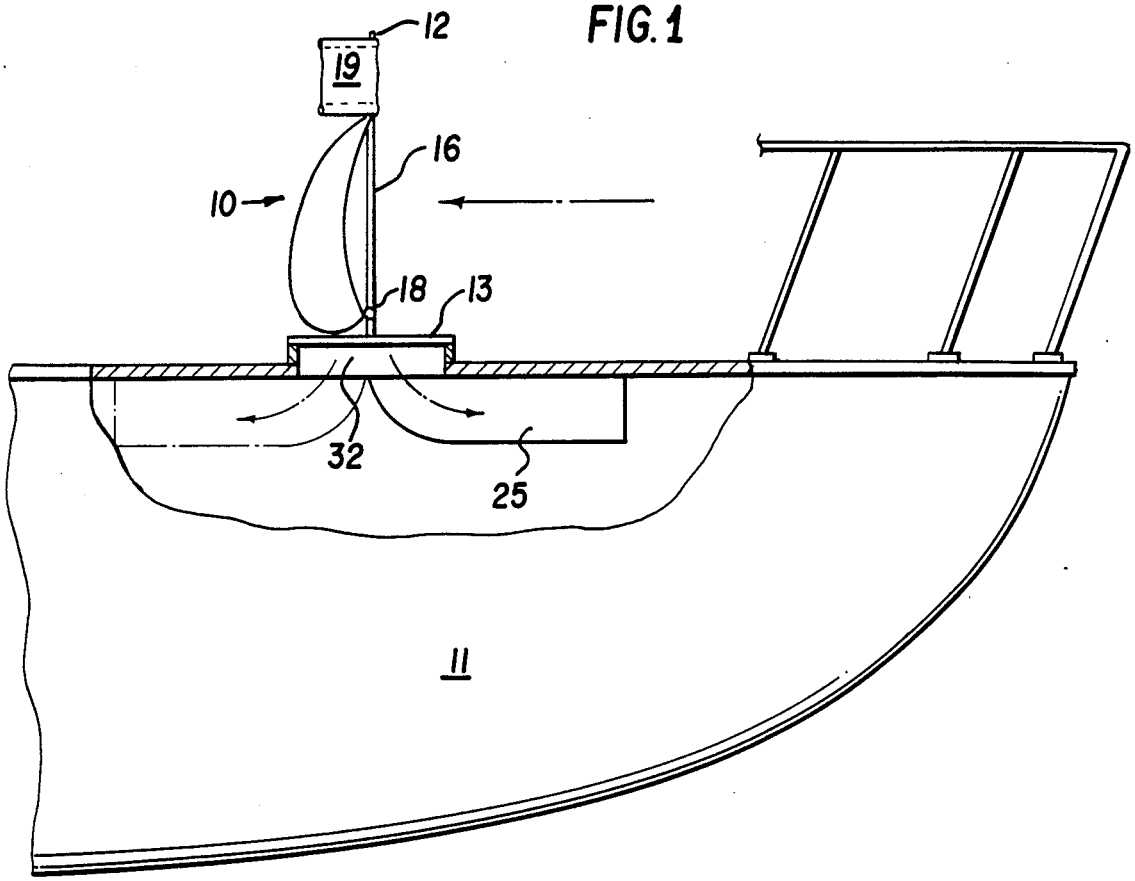
FIG. 1 is a partial cutaway view of a boat equipped with the wind scoop of the invention.
Figure 2:
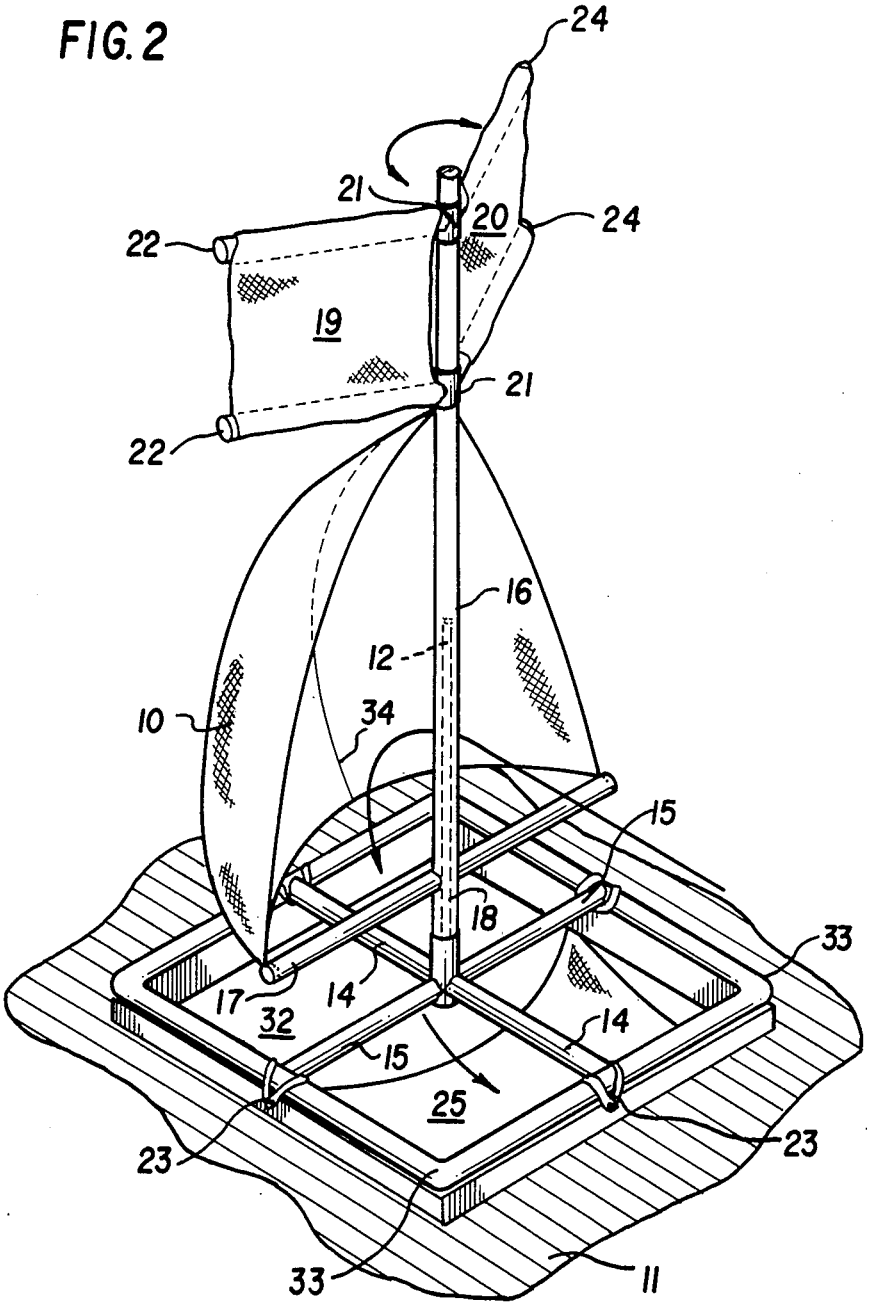
FIG. 2 is a perspective view of the wind scoop showing the mast means and the swivel means.

As shown in FIGS. 1 and 2, the invention is a wind scoop for ventilating the enclosed interior area of a boat through a hatch opening thereof. In accordance with the invention, flexible sail means are provided for continuously directing an air flow into the hatch opening regardless of the direction of the boat with respect to the wind. Mast means are provided for rotatably supporting the sail means above the hatch opening, and means for fastening the mast means to the boat above the hatch opening are included. As embodied herein, and illustrated in the drawings, the flexible sail means includes a sail 10 having a scoop-like shape. The sail may be formed of any suitable cloth-like material, and includes grommets for attaching the sail to the swivel means, described hereinafter. A thin plastic rib 34 may be sewn into the sail fabric at the bottom center thereof for providing some rigidity to the sail.

As shown in FIG. 2, the mast means includes a vertically extending mast 12 attached to a frame 13. The frame 13 and mast 12 may be formed of metal or other material having sufficient rigidity to withstand the forces of the wind encountered under normal conditions. The frame 13 may be formed in the shape of a square or rectangle as shown in FIG. 2. In this configuration, crosspieces 14 and 15 are provided for supporting the mast 12. The frame 13 may be attached to the boat over the hatch by any suitable means. For example, flexible cords 23 may be wrapped around the frame 13 and attached to hooks on the deck of the boat. The 23 may be located as shown, or may be placed at the corners 33 of the frame 13. Other known fasteners may also be used.

In accordance with the invention, wing means responsive to changes in the direction of the wind are provided for changing the orientation of the sail means. In addition, swivel means are provided for rotating the sail means on the mast means. As here embodied, the swivel means includes a hollow rod 16 which is sized to fit over and receive the mast 12 into the hollow portion thereof. The hollow rod 16 is vertically oriented for supporting the sail 10, and a horizontally oriented member 17 is attached to the lower end 18 of the hollow rod 16 for further supporting the sail. As here embodied, the wing means includes a pair of winglike projections 19 and 20 mount to the upper end 21 of the hollow rod 16. The projections 19 and 20 extend at a 90° angle from a fitting 21 which is attached to the hollow rod 16, and are of sufficient size to cause the hollow rod 16 and the attached sail 10 to rotate under the force of the wind. The projections 19 and 20 may be formed of cloth-like material similar to that used in making the sail 10. The cloth may be mounted on two parallel pairs of arms 22 and 24 which extend from the fitting 21 in the hollow rod 16 and support the cloth to form the wing-like projections 19 and 20.

As shown in FIG. 2, the hollow rod 16 fits over the mast 12 and rotates freely thereon. Thus, when the frame 13 is attached to the boat 11, over a hatch opening 32, the projections 19 and 20 react to the wind causing the sail 10 to be oriented for catching the wind. The shape of the sail 10 catches the wind and directs it downwardly into the hatch opening 32 of the boat. As the wind direction changes, the projections 19 and 20 react to the force of the wind causing the hollow rod 16 to rotate on the mast 12. This reorients the sail 10 and maintains a continuous air flow of ventilating air through the hatch opening 32 into the interior space of the boat 11.

For further directing the wind, an auxiliary scoop 25 may also be provided. As shown in FIG. 1, the auxiliary scoop may be attached within the boat below the hatch opening 32 for receiving the air from the sail 10 and directing it to a specific part of the interior of the boat 11. The auxiliary scoop 25 may be attached by any suitable fastening means such as velcro fasteners, or snaps (not shown).

Figure 3:
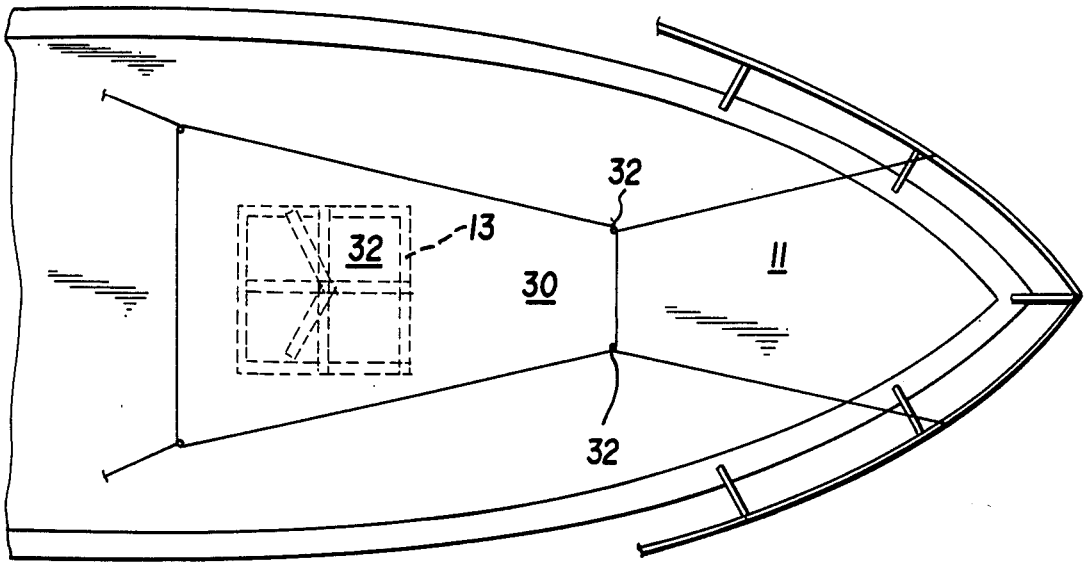
FIG. 3 is a top view of the wind scoop including the rain cover.

The wind scoop may also be provided with a rain cover 30 for mounting above the wind scoop to protect the sail 10, and the hatch opening from the rain. As shown in FIG. 3, the rain cover 30 may be formed of any suitable cloth-like material of light weight which is waterproof. The rain cover 30 may include grommets 32 or other fastening devices for attaching it to a framework, or to portions of the boat super-structure.

Thus, the invention provides a practical and useful device which may be economically manufactured, and which meets an important need. While the preferred embodiment described is particularly used with pleasure boats, the invention may be used with any vessel or other structure such as a recreational vehicle which may be ventilated through an opening.

It will be apparent to those skilled in the art that various modifications and variations could be made in the invention without departing from the scope or spirit of the invention.

What is claimed is:

1. A wind scoop for ventilating the enclosed interior area of a boat through a generally horizontally disposed hatch opening thereof, comprising:

flexible sail means made of a cloth-like material and being oriented for continuously directing an air flow into said hatch opening independent of the direction of said boat with respect to the wind, the orientation of said flexible sail means being responsive to the direction of the wind;

mast means for rotatably supporting said sail means above said hatch opening;

and means for fastening said mast means to said boat above said hatch opening.

2. The wind scoop of claim 1 also including wing means responsive to changes in the direction of said wind for changing the orientation of said sail means;

and swivel means for rotating said sail means on said mast means.

3. The wind scoop of claim 2 wherein said sail means includes a sail having a scoop-like shape, and said swivel means includes a hollow vertically oriented rod for supporting said sail.

4. The wind scoop of claim 3 wherein said hollow rod includes upper and lower portions, and said swivel means includes a horizontally oriented member attached to said lower end for further supporting said sail.

5. The wind scoop of claim 4 wherein said mast means is includes a frame for attachment to said boat and a mast extending vertically from said frame, said hollow rod being sized for receiving said mast into the hollow portion thereof for rotating said hollow rod on said mast.

6. The wind scoop of claim 5 also including removable flexible auxiliary scoop means mounted within said boat below said hatch for further directing the air flow within said boat.

7. The wind scoop of claim 6 wherein said auxiliary scoop means includes means for attaching said scoop means to said boat.

8. The wind scoop of claim 7 wherein said attaching means includes velcro fasteners.

9. The wind scoop of claim 7 wherein said attaching means includes snaps.

10. The wind scoop of claim 1 also including a rain cover for mounting over said sail means.

* * * * *